US009979063B2

(12) United States Patent
Mansour

(10) Patent No.: US 9,979,063 B2
(45) Date of Patent: May 22, 2018

(54) ROD-SWITCHED TUNABLE FILTER

(71) Applicant: Huawei Technologies Canada Co., Ltd., Ottawa (CA)

(72) Inventor: Raafat Mansour, Ottawa (CA)

(73) Assignee: Huawei Technologies Cananda Co., Ltd., Kanata/Ontario ( * ) Notice: Subject to any disclaimer, the term of this patent is extended or adjusted under 35 U.S.C. 154(b) by 135 days.

(21) Appl. No.: 15/043,150

(22) Filed: Feb. 12, 2016

(65) Prior Publication Data

US 2017/0237142 A1 Aug. 17, 2017

(51) Int. Cl.

| | |
|---|---|
| ***H01P 1/202*** | (2006.01) |
| ***H01P 7/04*** | (2006.01) |
| ***H01P 7/06*** | (2006.01) |
| ***H01P 1/20*** | (2006.01) |
| ***H01P 1/207*** | (2006.01) |
| ***H01P 1/205*** | (2006.01) |

(52) U.S. Cl.

CPC ..... *H01P 1/202* (2013.01); *H01P 1/2002* (2013.01); *H01P 1/205* (2013.01); *H01P 1/207* (2013.01); *H01P 1/2053* (2013.01); *H01P 7/04* (2013.01); *H01P 7/06* (2013.01)

(58) Field of Classification Search

CPC ..... H01P 1/205; H01P 1/2053; H01P 1/208; H01P 3/00; H01P 3/06; H01P 7/04; H01P 7/06; H01P 1/202

USPC ..... 333/207–209, 231–233, 258, 262, 333/223–225

See application file for complete search history.

(56) References Cited

U.S. PATENT DOCUMENTS

| | | | | |
|---|---|---|---|---|
| 2,731,604 | A * | 1/1956 | Hubbard | H01P 7/04 333/223 |
| 3,451,014 | A * | 6/1969 | Curley | H01P 1/212 333/110 |
| 3,555,465 | A * | 1/1971 | Kuroda et al. | H01H 51/28 333/207 |
| 3,680,012 | A * | 7/1972 | Moreau | H01P 1/208 333/209 |
| 7,825,754 | B2 | 11/2010 | Kawai et al. | |
| 9,236,846 | B2 | 1/2016 | Azarnaminy et al. | |
| 2012/0293281 | A1* | 11/2012 | Chun | H01P 1/2084 333/202 |

FOREIGN PATENT DOCUMENTS

| | | | |
|---|---|---|---|
| CN | 1964130 | A | 5/2007 |
| CN | 101212076 | A | 7/2008 |
| CN | 103390783 | A | 11/2013 |
| WO | 2009056813 | A1 | 5/2009 |

OTHER PUBLICATIONS

International Search Report of PCT/CN2016/076770 dated Nov. 16, 2016.

* cited by examiner

*Primary Examiner* — Rakesh Patel

(57) ABSTRACT

A rod-switched tunable resonator includes a housing defining a cavity, a first rod disposed within the cavity, a second rod disposed within the cavity, and a switch connected to the first rod and to the second rod to tune the resonator to one of a plurality of frequencies by connecting or disconnecting one or both of the first and second rods to the housing. A tunable filter may be fabricated using two or more such resonators. The rod-switched tunable resonator may be a combline resonator, coaxial resonator, waveguide resonator, or dielectric resonator.

21 Claims, 9 Drawing Sheets

ROD-SWITCHED TUNABLE FILTER

TECHNICAL FIELD

The present disclosure relates generally to wireless telecommunications and, in particular to, tunable filters.

BACKGROUND

Tunable filters can provide more than one filter response using tuning elements integrated into the filter topology and therefore a single tunable filter can be adapted to multiple frequency bands. The most common tunable parameter in microwave filters is the center frequency. In discrete tuning, finite values of center frequencies are supported by the tuning devices whereas in continuous tuning a continuum range of frequencies is supported. Different tuning methods including mechanical, magnetic, and electrical tuning have been proposed to construct tunable filters with either discrete or continuous tuning. Tuning methods are evaluated in terms of different metrics including their tuning range, quality factor, power handling capability, fabrication complexity, size, and tuning speed. None of the tuning methods is superior in terms of all metrics and, therefore, depending on the application and design constraints, one tuning method might be preferred over the other in a particular application or use.

Mechanical tuning is easy to implement and provide a relatively high power handling capability. However, they have low tuning speed and are usually bulky in size. Micro Electro-Mechanical Systems (MEMS) technology is an attractive approach to realize tunable filters with a compact size. Integration of MEMS devices with three dimensional resonators is a challenge leading to a significant degradation in the resonator Q-factor.

Accordingly, there remains a need in the industry for an improved tunable filter.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

The present specification discloses, in general, a tunable resonator having two or more rods per resonator. Also disclosed herein is a tunable filter that includes two or more such resonators. In each resonator, there are two or more rods which are of different size and/or asymmetrically disposed within the cavity. Each rod can be switched on or off by connecting or disconnecting the rod to a cavity wall or housing. Thus, switching of the rods changes the field distribution and accordingly changes the resonant frequency of the resonator to thereby tune the filter to the desired frequency.

One inventive aspect of the disclosure is a rod-switched tunable resonator having a housing defining a cavity, a first rod disposed within the cavity, a second rod disposed within the cavity, and a switch connected to the first rod and to the second rod to tune the resonator to one of a plurality of frequencies by connecting or disconnecting one or both of the first and second rods to the housing.

Another inventive aspect of the disclosure is a rod-switched tunable filter having a first resonator, a second resonator adjoining the first resonator, wherein each of the first and second resonators includes a housing defining a cavity, a first rod disposed within the cavity, a second rod disposed within the cavity and a switch connected to the first rod and to the second rod to tune the resonator to one of a plurality of frequencies by connecting or disconnecting one or both of the first and second rods to the housing.

Yet another inventive aspect of the disclosure is a method of tuning a resonator. The method entails disposing a first electrically conductive rod inside a cavity of the resonator, disposing a second electrically conductive rod inside the cavity of the resonator, and switching on or off one or both of the first rod and the second rod to tune the resonator.

BRIEF DESCRIPTION OF THE DRAWINGS

These and other features of the disclosure will become more apparent from the description in which reference is made to the following appended drawings.

DETAILED DESCRIPTION OF EMBODIMENTS

Figure 1:
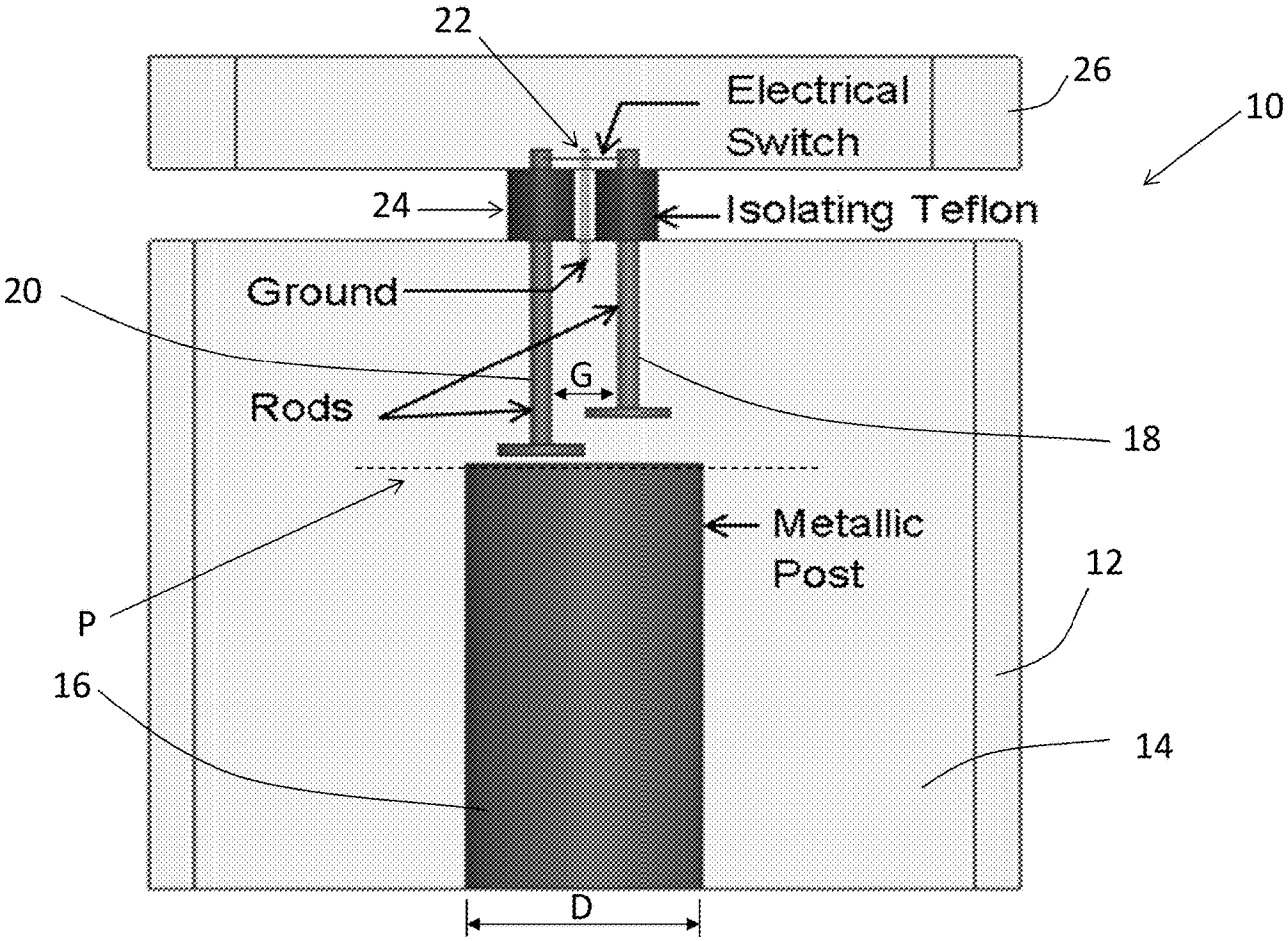
FIG. 1 is a side view of a rod-switched tunable resonator, implemented by way of example as a combline resonator, in accordance with one embodiment of the present invention.

The following detailed description contains, for the purposes of explanation, numerous specific embodiments, implementations, examples and details in order to provide a thorough understanding of the invention. It is apparent, however, that the embodiments may be practiced without these specific details or with an equivalent arrangement. In other instances, some well-known structures and devices are shown in block diagram form in order to avoid unnecessarily obscuring the embodiments of the invention. The description should in no way be limited to the illustrative implementations, drawings, and techniques illustrated below, including the exemplary designs and implementations illustrated and described herein, but may be modified within the scope of the appended claims along with their full scope of equivalents.

In general, disclosed herein is a tunable resonator having two or more rods that can be disposed anywhere inside the cavity although some locations will be more sensitive than others. Connecting the rods to the cavity wall (i.e. housing) changes the electromagnetic field distribution inside the cavity and hence changes the resonant frequency, i.e. the frequency at which the electric energy (We) stored in the electric field is equal to the magnetic energy (Wm) stored in magnetic field, i.e. We=Wm. The inventive concept is applicable to any cavity resonator, such as a coaxial resonator, waveguide resonator or dielectric resonator. It is also applicable to a cavity with an electrically conductive post inside (i.e. a combline resonator).

The rods can be switched (i.e. connected to the housing or cavity wall) to define various switch states each exhibiting its own electromagnetic field distribution within the resonator. At each of the different states, the condition We=Wm occurs at a corresponding resonant frequency. Each switch state thus corresponds to a different resonant frequency of the resonator. In a simple implementation, there are two rods inside the cavity, thereby providing four switch states, i.e. four tunable frequencies. However, it is important to note that the number of rods inside the cavity is not restricted to two rods per resonator. The number of tuning states (i.e. frequencies) is equal to $2^N$ where N is the number of rods. Thus, 2 rods provides 4 states, 3 rods provides 8 states, 4 rods provides 16 states, 5 rods provides 32 states, and so on.

The rods may be switched (electrically connected to the cavity walls) using any suitable radio frequency (RF) switch, such as, for example, RF MEMS switches. The rods can alternatively be switched by mechanical relay switches, semiconductor switches, or phase change material type switches or any other suitable switch.

In the embodiments illustrated in the figures, and as will be described below in greater detail, a tunable resonator can be tuned to desired frequencies, e.g. center frequencies (or resonant frequencies) by switching two or more rods inside a cavity within the resonator to change the electromagnetic field distribution inside the resonator.

Some specific embodiments are now described by way of example to further illustrate particular implementations of the technology. These examples are meant solely to further elucidate the inventive concept and to restrict the inventive concept to these particular implementations.

Figure 2:
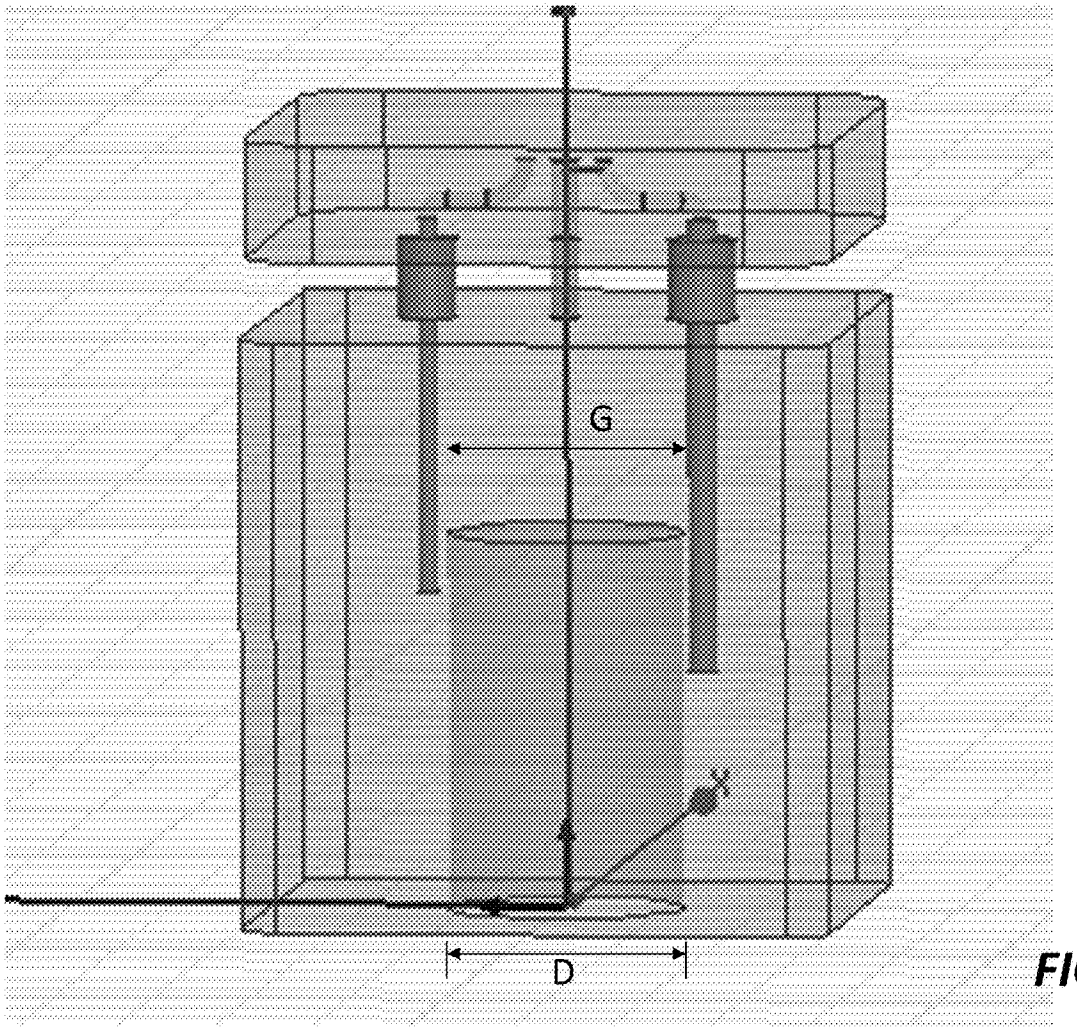
FIG. 2 is an isometric view of a rod-switched tunable resonator.
Figure 3:
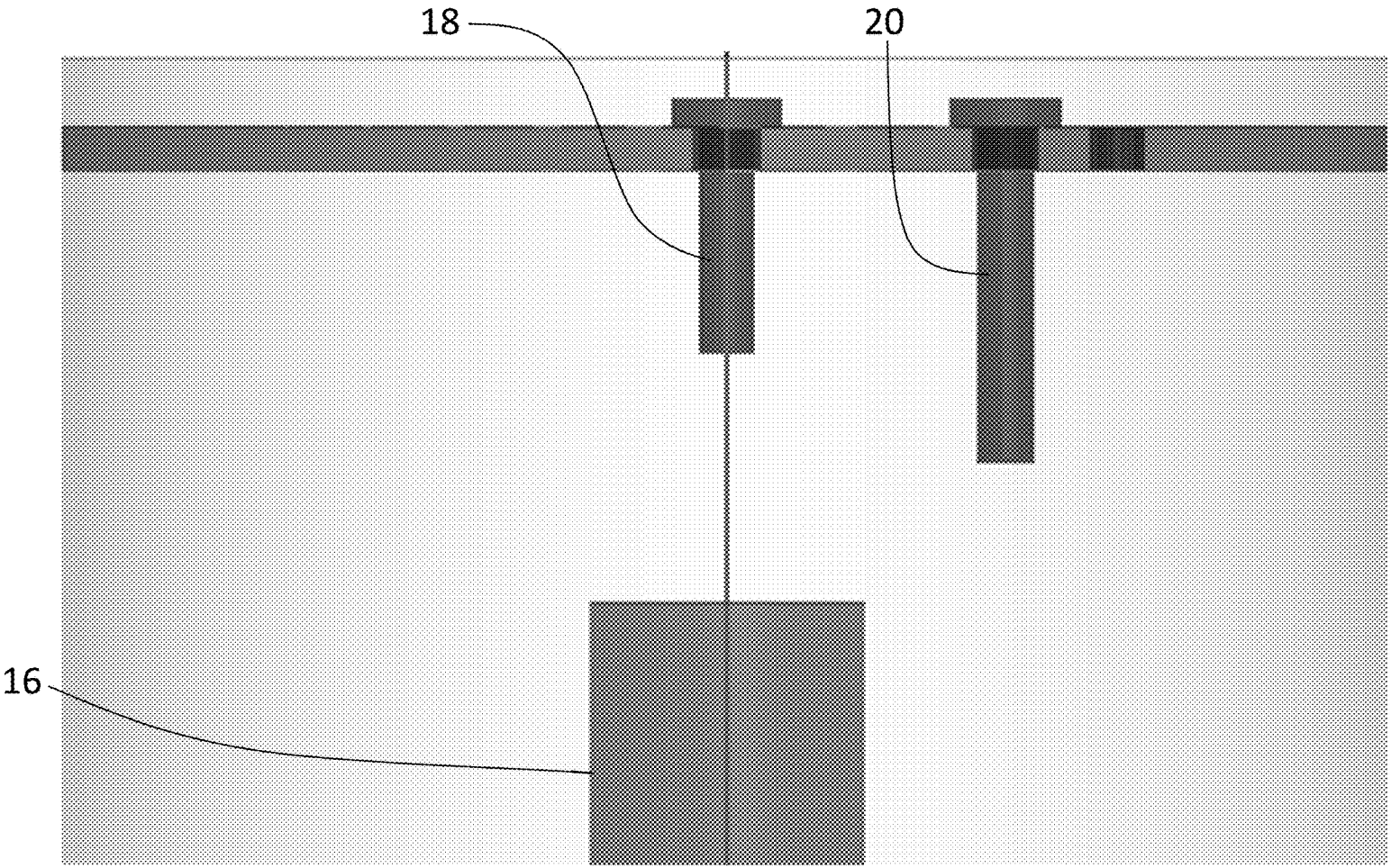
FIG. 3 is a side view of a resonator having a short rod that is vertically aligned with the post.

A first example implementation is depicted in FIGS. 1-3. In this example, the resonator is implemented in the form of a combline resonator. In the embodiment depicted by way of example in FIG. 1, a rod-switched tunable resonator, which is generally designated by reference numeral 10, includes a housing 12 defining a cavity 14. The housing (enclosure) 12 has cavity walls. The housing 12 may have a cubical shape, cylindrical shape or any other suitable shape. The housing 12 is made of an electrically conductive material such as, for example, aluminum. For this particular implementation as a combline resonator, an electrically conductive post 16 (e.g. metallic post) is disposed within the cavity of the housing. The resonator includes an electrically conductive first rod 18 providing the first switchable tuning element. The resonator also includes an electrically conductive second rod 20 providing the second switchable tuning element. In one embodiment, the rods may be made of copper or other suitable electrically conductive material. The resonator further includes an electric switch 22 connected to the first rod 18 and the second rod 20 to either connect or disconnect the first and/or second rods to the cavity walls (of the housing 12). The rods 18 and 20 are insulated from the housing by a Teflon isolator 24. The switch 22 is a single pole double throw (SPDT) switch having three terminals one of which is grounded i.e. connected to the housing, the other two terminals being connected to the rods, thus connecting or disconnecting the rods to the housing as the switch turns ON or OFF. The switch 22 therefore has four switch states, i.e. S(0,0), S(1,0), S(0,1) and S(1,1) wherein the notation S(x,y) represents the switch state and wherein x is 0 for off (disconnected from wall) and 1 for on (connected to wall) for the first rod 18 and wherein y is 0 for off (disconnected) and 1 for on (connected) for the second rod 20. The switch 22 is disposed within a switch-containing holder 26 that is disposed above and spaced apart from the housing. In an alternate embodiment, the functionality of the SPDT can be achieved with the use of two Single-Pole-Single-Throw (SPST) switches with each SPST switch having two terminals. In this alternate embodiment, one terminal is connected to the housing and the other terminal is connected to the rod, thus connecting or disconnecting the rod to the housing as the switch is turned ON or OFF. As shown by way of example in FIG. 1, the resonator has two rods having different lengths $L_1$ and $L_2$. In this example, the first rod 18 is a short rod and the second rod 20 is a long rod.

The rods 18, 20 are mounted in this example above the electrically conductive (e.g. metallic) post, as illustrated in FIG. 1, although in other embodiments the rods may be placed elsewhere inside the cavity. The rods 18, 20 are isolated from the housing using isolating Teflon in this example. An electrical switch 22 with a grounded input is mounted on top of the rods. When the switch 22 is off, both rods are floating (disconnected from the cavity walls). In the ON state, the selected rod(s) are electrically connected to the cavity walls.

In the embodiment illustrated by way of example in FIG. 1, the post is cylindrical and the short and long rods 18, 20 are also cylindrical. In the embodiment depicted in FIG. 1, the short and long rods 18, 20 extend downwardly to lowest points that are above a plane P defined by an upper surface of the post 16. Again, it will be appreciated that this specific configuration is presented only as an example. The disposition of the rods 18, 20 may be varied in other embodiments.

In another embodiment, the short and long rods 18, 20 are separated by a gap G greater than a diameter D of the post 16. In this embodiment, the short and long rods 18, 20 may extend downwardly to lowest points that are below the plane P defined by the upper surface of the post 16 as shown by way of example in FIG. 3. It should be recalled that this is strictly one specific example of a combline resonator implementation and that there is no general restriction on the location of each of the rods inside the cavity.

In the embodiment illustrated in FIG. 1, a disk 24 is optionally connected to an end of each of the short and long rods 18, 20. Alternatively, another shape, e.g. a spheroid, may be optionally connected to an end of each of the short and long rods.

In the embodiment depicted by way of example in FIG. 1, the diameter $d_s$ of the short rod is shown to be equal to the diameter $d_l$ of the long rod. Alternatively, in the embodiment depicted in FIG. 3, the diameter $d_s$ of the short rod is shown to differ from the diameter of the long rod $d_l$. Specifically, in this example shown in FIG. 3, the diameter $d_l$ of the long rod is shown to be greater than the diameter $d_s$ of the short rod. Although specific examples are shown in these figures, it will be understood that in general the diameter of the first rod and the second rod may be the same or different, and that the lengths of the rods may be the same or different. The placement of the rods within the cavity may be symmetrical or asymmetrical.

In the embodiment depicted by way of example in FIG. 3, one of the rods 18, 20 may be vertically aligned with the post. In this figure, the short rod 18 is shown to be aligned with the post 16. However, it will be appreciated that the long rod 20 may be aligned with the post in another embodiment. As noted above, in other embodiments, the rods may be placed at other locations within the cavity.

Figure 4:
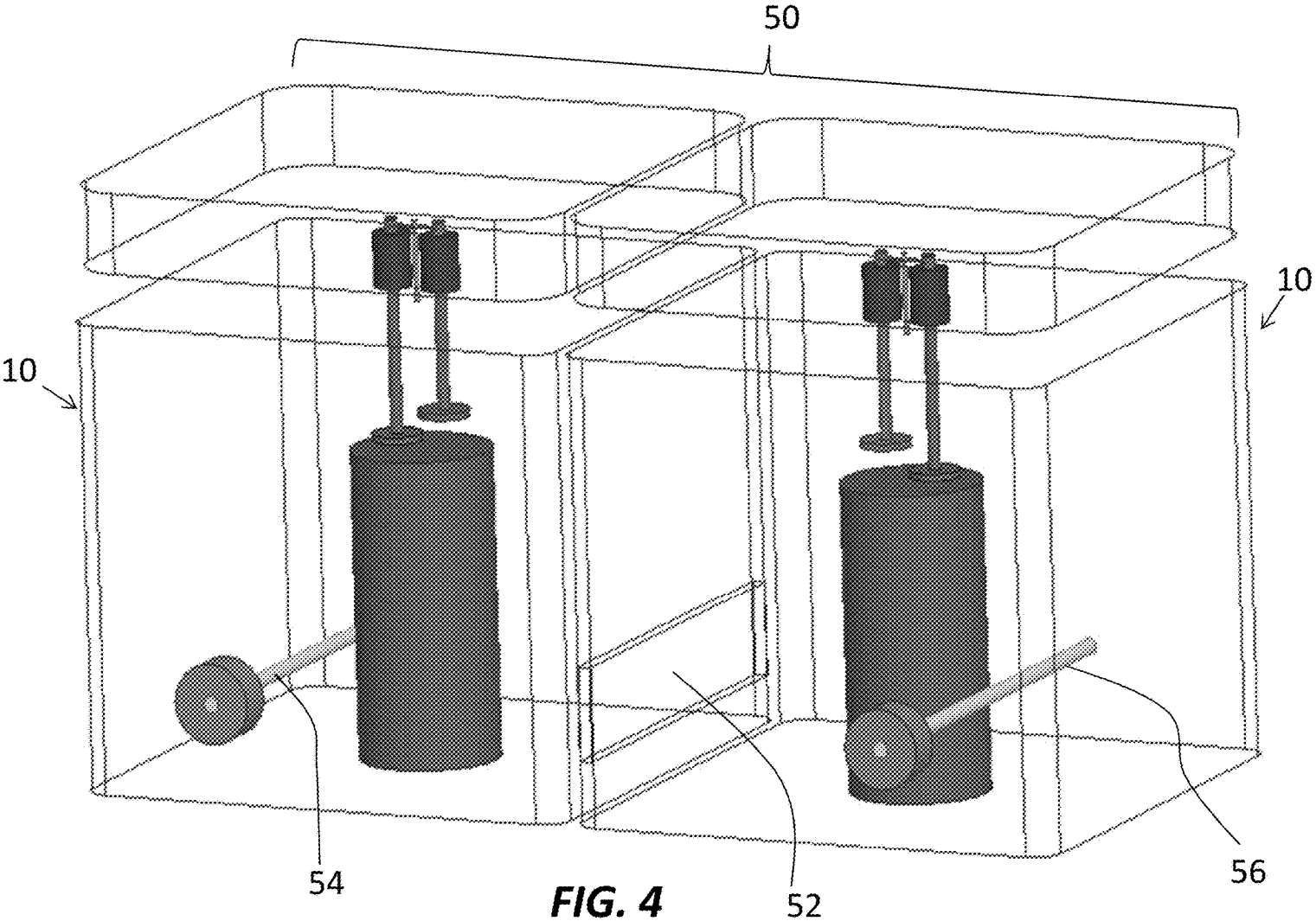
FIG. 4 is an isometric view of a rod-switched tunable filter composed of two adjoining rod-switched tunable resonators.

Two or more resonators 10 may be adjoined to each other to constitute a rod-switched tunable filter 50, an example of which is depicted in FIG. 4. In other embodiments, the tunable filter 50 is not limited only to two resonators (i.e. order 2). The tunable filter can be of any order, e.g. 2, 3, 4, etc. The filter may be composed of two or more resonators. The resonators may be combline resonators, coaxial resonators, waveguide resonators, or dielectric resonators.

Figure 5:
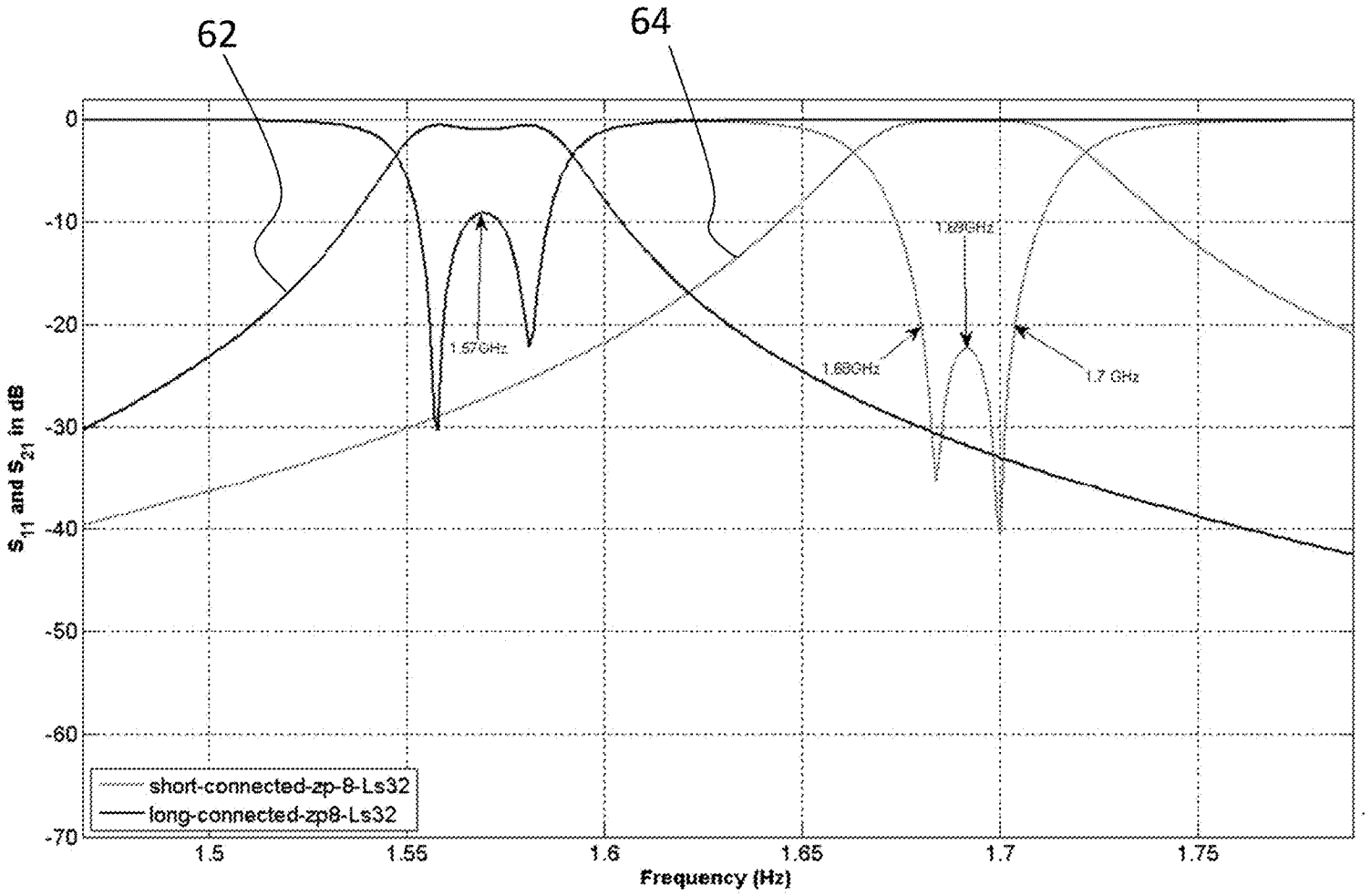
FIG. 5 presents a graph plotting frequency for the short-connected rod and the long-connected rod.

The rod-switched tunable filter 50 shown by way of example in FIG. 4 includes a first resonator and a second resonator adjoining the first resonator. Each of the first and second resonators has a housing defining an internal cavity, as was described above, an electrically conductive post, an electrically conductive short rod providing a first switchable tuning element, an electrically conductive long rod providing the second switchable tuning element, and a switch connected to the first rod 18 and the second rod 20 to cavity walls of the housing 12. In the embodiment shown by way of example in FIG. 4, the filter has an iris 52 between the first and second resonators. In the embodiment depicted by way of example in FIG. 5, the iris 52 is a rectangular opening extending through the housing of each of the first and second resonators.

In the embodiment depicted in FIG. 4, the filter has a first probe 54 extending into the first resonator and a second probe 56 extending into the second resonator to provide a coupling between the first and second resonators. In the illustrated embodiment, the first probe is parallel to the second probe and wherein the first and second probes are orthogonal to the first and second rods.

Figure 6:
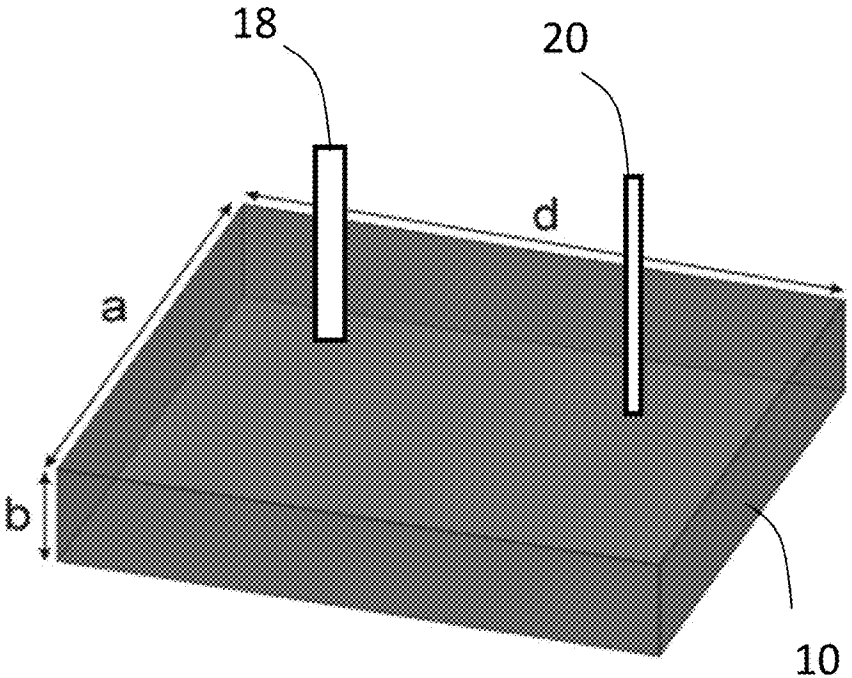
FIG. 6 depicts a rectangular waveguide resonator as another example of a rod-switched tunable resonator in accordance with another embodiment.

As a proof of concept, an S-band two-pole tunable combline filter with a bandwidth of 30 MHz was constructed using two resonators as shown in FIG. 4. Each resonator had aluminum housing and rods made of copper which were isolated from the cavity walls using isolating Teflon. The coupling between the two resonators was realized using the horizontal iris 52. Since the electric/magnetic field distribution inside the cavity changes as the state of switch changes, the iris should be positioned to minimize the coupling variation. The input/output coupling was realized using a long probe inserted into the cavity of each resonator. The probe position was selected to minimize the input/output coupling variation as the state of switch changes. Results generated using a high-frequency structural simulator (HFSS) are presented graphically in FIG. 5. In the graph of FIG. 6, the loss (in dB) is plotted as a function of frequency for both the short-connected rod and the long-connected rod. Plot line 62 represents the long-connected rod whereas plot line 64 represents the short-connected rod. The minimum loss for the long-connected rod occurs at 1.57 GHz. The minimum loss for the short-connected rod occurs at 1.69 GHz. These represent the center frequencies for the filter. The center frequency of the filter can thus be tuned from 1.57 GHz to 1.69 GHz as the state of switch changes from the long rod to the short rod. The center frequency can also be tuned back to 1.57 GHz by switching back to the long rod.

FIG. 6 depicts a rectangular waveguide resonator 10 as another example of a rod-switched tunable resonator in accordance with another embodiment. The rectangular waveguide resonator 10 illustrated in this figure has two rods 18, 20 of different length and different diameter. Alternatively, the rods may have the same length, but different diameters. Alternatively, the rods may have the same diameter, but different lengths. Alternatively, the rods may have the same length and diameter but are located asymmetrically inside the cavity in such a way as to interact differently with the field distribution inside the cavity, thereby providing two different frequencies as the rods are selectively connected to the housing.

Figure 7:
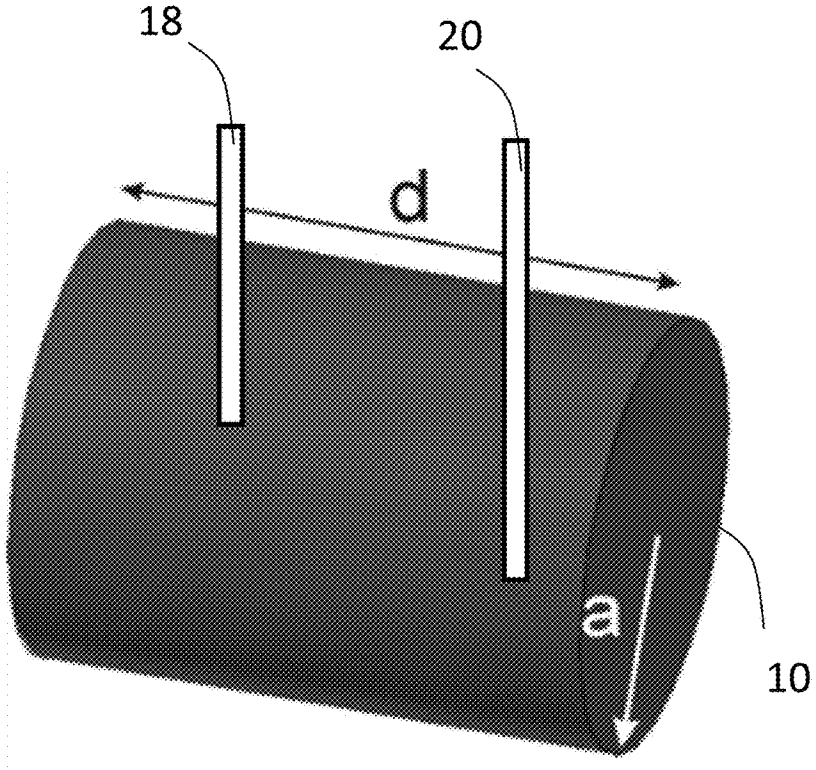
FIG. 7 depicts a cylindrical waveguide resonator as another example of a rod-switched tunable resonator in accordance with another embodiment.

FIG. 7 depicts a cylindrical waveguide resonator as another example of a rod-switched tunable resonator in accordance with another embodiment. The cylindrical waveguide resonator 10 illustrated in this figure has two rods 18, 20 of different length but of the same diameter. Alternatively, the rods may have the same length, but different diameters. Alternatively, the rods may different lengths and different diameters. Alternatively, the rods may have the same length and diameter but are located asymmetrically inside the cavity in such a way as to interact differently with the field distribution inside the cavity, thereby providing two different frequencies as the rods are selectively connected to the housing.

Figure 8:
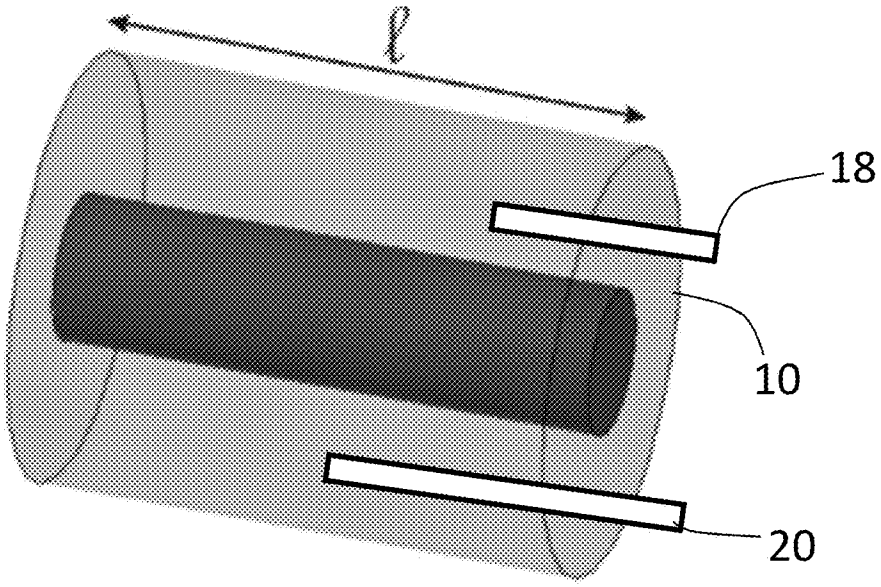
FIG. 8 depicts a coaxial resonator as another example of a rod-switched tunable resonator in accordance with another embodiment.

FIG. 8 depicts a coaxial resonator as another example of a rod-switched tunable resonator in accordance with another embodiment. The coaxial resonator 10 illustrated in this figure has two rods 18, 20 of different length but of the same diameter. Alternatively, the rods may have the same length, but different diameters. Alternatively, the rods may different lengths and different diameters. Alternatively, the rods may have the same length and diameter but are located asymmetrically inside the cavity in such a way as to interact differently with the field distribution inside the cavity, thereby providing two different frequencies as the rods are selectively connected to the housing.

Figure 9:
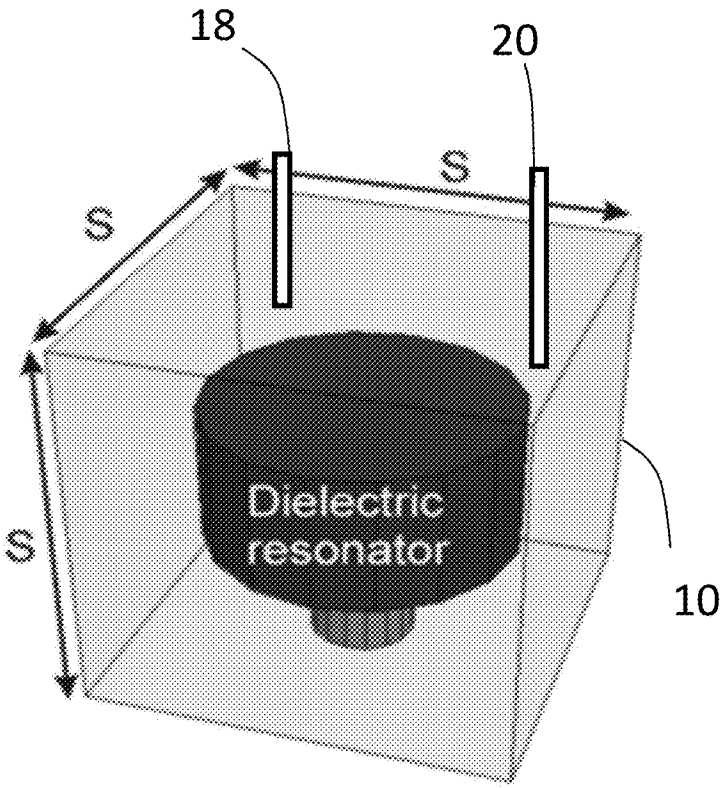
FIG. 9 depicts a dielectric resonator as another example of a rod-switched tunable resonator in accordance with another embodiment.

FIG. 9 depicts a dielectric resonator as another example of a rod-switched tunable resonator in accordance with another embodiment. The dielectric resonator 10 illustrated in this figure has two rods 18, 20 of different length and different diameter. Alternatively, the rods may have the same length, but different diameters. Alternatively, the rods may have the same diameter, but different lengths. Alternatively, the rods may have the same length and diameter but are located asymmetrically inside the cavity in such a way as to interact differently with the field distribution inside the cavity, thereby providing two different frequencies as the rods are selectively connected to the housing.

In other embodiments, the rods may be replaced by electrically conductive members having non-cylindrical or non-uniform shapes. In other embodiments, the rods need not be parallel to each other.

Another aspect of the present disclosure is a method of tuning a resonator, or a filter having two such resonators. The tuning method uses an electrical switch to tune the center frequency by switching between the first and second rods with the cavity of the resonator. More specifically, the method entails steps, acts or operations of disposing an electrically conductive post within a cavity of a housing of the resonator, disposing an electrically conductive first rod, disposing an electrically conductive second rod, and switching on or off one or both of the first rod and the second rod to tune the resonator. By connecting the first and second rods to the housing of the resonator, the electromagnetic field distribution changes within the cavity.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing", or verb tense variants thereof, are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g. "such as") is intended merely to better illustrate or describe embodiments of the invention and is not intended to limit the scope of the invention unless otherwise claimed.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented. As described above, the cavity resonator could be a combline resonator, coaxial resonator, waveguide resonator, or dielectric resonator. The number of rods in each cavity resonator may be two or greater. It will also be understood that the filter could be composed of two or more resonators.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the inventive concept(s) disclosed herein.

The invention claimed is:

1. A rod-switched tunable resonator comprising:
an electrically conductive housing defining a cavity;
an electrically conductive post within the cavity and electrically connected to the housing;
a first electrically conductive rod disposed within the cavity and electrically insulated from the housing;
a second electrically conductive rod disposed within the cavity and electrically insulated from the housing; and
a switch connected to the first rod and to the second rod to tune the resonator to one of a plurality of frequencies by electrically connecting or disconnecting one or both of the first and second rods to the housing.

2. The resonator of claim 1 wherein the first and second rods are of different length.

3. The resonator of claim 1 wherein the first and second rods are of different diameter.

4. The resonator of claim 1 wherein the first and second rods are asymmetrically disposed within the cavity.

5. The resonator of claim 1 further comprising a disk connected to an end of each of the first and second rods.

6. The resonator of claim 1 comprising more than two rods in the cavity.

7. A rod-switched tunable filter comprising:
a first resonator;
a second resonator adjoining the first resonator;
wherein each of the first and second resonators comprises:
an electrically conductive housing defining a cavity;
an electrically conductive post within the cavity and electrically connected to the housing;
a first electrically conductive rod disposed within the cavity and electrically insulated from the housing;
a second electrically conductive rod disposed within the cavity and electrically insulated from the housing; and
a switch connected to the first rod and to the second rod to tune the resonator to one of a plurality of frequencies by electrically connecting or disconnecting one or both of the first and second rods to the housing.

8. The filter of claim 7 wherein the first rod and the second rod of each resonator have different lengths.

9. The filter of claim 7 wherein the first rod and the second rod of each resonator have different diameters.

10. The filter of claim 7 wherein the first rod and the second rod of each resonator are asymmetrically disposed within each cavity.

11. The filter of claim 7 wherein the first and second resonators are combline resonators.

12. The filter of claim 7 wherein the first and second resonators are coaxial resonators.

13. The filter of claim 7 wherein the first and second resonators are waveguide resonators.

14. The filter of claim 7 wherein the first and second resonators are dielectric resonators.

15. The filter of claim 7 further comprising an iris extending through the housing of each of the first and second resonators.

16. The filter of claim 15 further comprising a first probe extending into the first resonator and a second probe extending into the second resonator to provide a coupling between the first and second resonators, wherein the first probe is parallel to the second probe and wherein the first and second probes are orthogonal to the first and second rods.

17. A method of tuning a resonator, the method comprising:
disposing an electrically conductive post within a cavity defined by an electrically conductive housing;
disposing a first electrically conductive rod inside a cavity of the resonator such that the first electrically conductive rod is electrically insulated from the housing;
disposing a second electrically conductive rod inside the cavity of the resonator such that the second electrically conductive rod is electrically insulated from the housing; and
switching on or off one or both of the first rod and the second rod to tune the resonator by electrically connecting or disconnecting one or both of the first and second rods to the housing.

18. The method of claim 17 wherein disposing the first rod and disposing the second rod are performed by asymmetrically disposing the first and second rods within the cavity.

19. The method of claim 17 wherein the first rod and second rod have different lengths.

20. The method of claim 17 wherein the first rod and second rod have different diameters.

21. A rod-switched tunable resonator comprising:
an electrically conductive housing defining a cavity;
an electrically conductive post within the cavity;
a first electrically conductive rod disposed within the cavity and electrically insulated from the post;
a second electrically conductive rod disposed within the cavity and electrically insulated from the post; and
a first switch connected between the first rod and the housing and a second switch connected between the second rod and the housing to tune the resonator to one of a plurality of frequencies by selectively electrically connecting one or both of the first and second rods to the housing.

* * * * *